US005338322A

United States Patent [19]

Ignasiak et al.

[11] Patent Number: 5,338,322

[45] Date of Patent: Aug. 16, 1994

[54] PROCESS FOR CONVERTING HEAVY OIL DEPOSITED ON COAL TO DISTILLABLE OIL IN A LOW SEVERITY PROCESS

[76] Inventors: Teresa Ignasiak, 417 Heffernan Drive, Edmonton, Alberta, Canada, T6R 1W4; Otto Strausz, 13119 Grand View Drive, Edmonton, Alberta, Canada, T6H 4K7; Boleslaw Ignasiak, 417 heffernan Drive, Edmonton, Alberta, Canada, T6R 1W4; Jerzy Janiak, 17820 - 76 Ave., Edmonton, Alberta, Canada, T5T 2G1; Wanda Pawlak, 3046 - 11465 - 41 Avenue, Edmonton, Alberta, Canada, T6J 0T9; Kazimierz Szymocha, 3125 - 109 Street, Edmonton, Alberta, Canada, T5J 4N6; Ali A. Turak, all of Edmonton, Canada

[21] Appl. No.: 9,534

[22] Filed: Jan. 27, 1993

Related U.S. Application Data

[63] Continuation of Ser. No. 738,210, Jul. 31, 1991, abandoned.

[30] Foreign Application Priority Data

Aug. 3, 1990 [CA] Canada ..... 2022721-4

[51] Int. Cl.[5] ..... C10L 5/00

[52] U.S. Cl. ..... 44/620; 208/434

[58] Field of Search ..... 44/620; 208/434

[56] References Cited

U.S. PATENT DOCUMENTS

| | | | |
|---|---|---|---|
| 3,779,893 | 12/1973 | Leas et al. | 208/10 |
| 3,870,621 | 3/1975 | Arnold et al. | 208/8 |
| 4,111,787 | 9/1978 | Aldridge et al. | 208/10 |
| 4,334,976 | 6/1982 | Yan | 208/434 |
| 4,364,817 | 12/1982 | Anderson et al. | 208/8 |
| 4,385,981 | 5/1983 | Neskora | 208/431 |
| 4,396,396 | 8/1983 | Mainwaring | 44/24 |
| 4,415,335 | 11/1983 | Mainwaring et al. | 44/1 C |
| 4,587,006 | 5/1986 | Minden | 208/410 |
| 4,589,973 | 5/1986 | Minden | 208/419 |
| 4,640,762 | 2/1987 | Woods | 208/56 |
| 4,854,940 | 8/1989 | Janiak | 44/620 |

FOREIGN PATENT DOCUMENTS

| | | |
|---|---|---|
| 1107943 | 9/1981 | Canada . |
| 1200778 | 2/1986 | Canada . |
| 1216551 | 1/1987 | Canada . |
| 51-53502 | 5/1976 | Japan . |
| 57-128794 | 8/1982 | Japan . |
| 113079 | 2/1918 | United Kingdom . |
| 131588 | 8/1919 | United Kingdom . |

*Primary Examiner*—Jacqueline V. Howard

*Attorney, Agent, or Firm*—Heller, Ehrman White & McAuliffe

[57] ABSTRACT

A process for removing oil from coal fines that have been agglomerated or blended with heavy oil comprises the steps of heating the coal fines to temperatures over 350° C. up to 450° C. in an inert atmosphere, such as steam or nitrogen, to convert some of the heavy oil to lighter, and distilling and collecting the lighter oils. The pressure at which the process is carried out can be from atmospheric to 100 atmospheres. A hydrogen donor can be added to the oil prior to deposition on the coal surface to increase the yield of distillable oil.

13 Claims, 1 Drawing Sheet

PROCESS FOR CONVERTING HEAVY OIL DEPOSITED ON COAL TO DISTILLABLE OIL IN A LOW SEVERITY PROCESS

This Invention was made with U.S. Government support under Contract No. DE-FG22-87PC79865 awarded by the Department of Energy. The U.S. Government has certain rights in this invention.

This is a continuation of application Ser. No. 07/738,210 filed Jul. 31, 1991, now abandoned.

BACKGROUND OF THE INVENTION

This invention relates to a process for recovering oil from coal fines that are agglomerated or blended with heavy oil.

Oil agglomeration of coal fines is generally practised using high rank coals and high quality oils as feedstock. The agglomerated low ash and low moisture product can be subjected to thermal treatment to recover the oil. For high quality, i.e. low boiling, oils, it is possible to recover almost 100% of the oil used. Methods of recovering light oils from agglomerates are described in U.S. Pat. Nos. 4,415,335, issued Nov. 15, 1983 to Mainwaring et al. and 4,396,396, issued Aug. 2, 1983 to Mainwaring.

It is also known to use low quality (i.e. heavy) oil in the agglomeration process. Canadian Patent No. 1,216,551 (Ignasiak), issued Jan. 13, 1987, is directed to a method for agglomerating subbituminous coal using heavy oil. In such processes, large quantities of heavy oil in the order of 10–50% of the weight of the coal, are used. U.S. Pat. No. 4,854,940 (Janiak et al. ) , issued Aug. 8, 1989, describes a method for separating distillable hydrocarbons from agglomerated subbituminous coal by contacting the agglomerates with steam or nitrogen at temperatures between 250°–350° C. However, this results in recovery of only about 25–40% of the heavy oil. Further, the heavy oil recovered using this method is not upgraded to lighter, more valuable oils, due to the relatively low temperatures employed. It would be economically desirable to be able to recover more of the heavy oil used, particularly in the form of lighter, distillable oils.

SUMMARY OF THE INVENTION

The present process is directed to a method of recovering oil from bituminous or subbituminous coal fines that have been agglomerated and/or blended with heavy oil, and, at the same time, converting some of the oil to lighter, distillable oils. The method involves heating the agglomerated or blended coal fines to temperatures between 350°–450° C. and condensing and collecting the oils distilled there from. The process is carried out in an inert atmosphere, such as steam or nitrogen. The process may be conducted at atmospheric pressure or at pressures up to about 100 atmospheres. It leaves the heaviest, asphaltenic fraction of the oil in the agglomerated coal fines, giving them a higher calorific value than agglomerates made by methods where light oil is used to form the agglomerates and then recovered there from.

DETAILED DESCRIPTION OF THE PREFERRED EMBODIMENT

Figure 1:
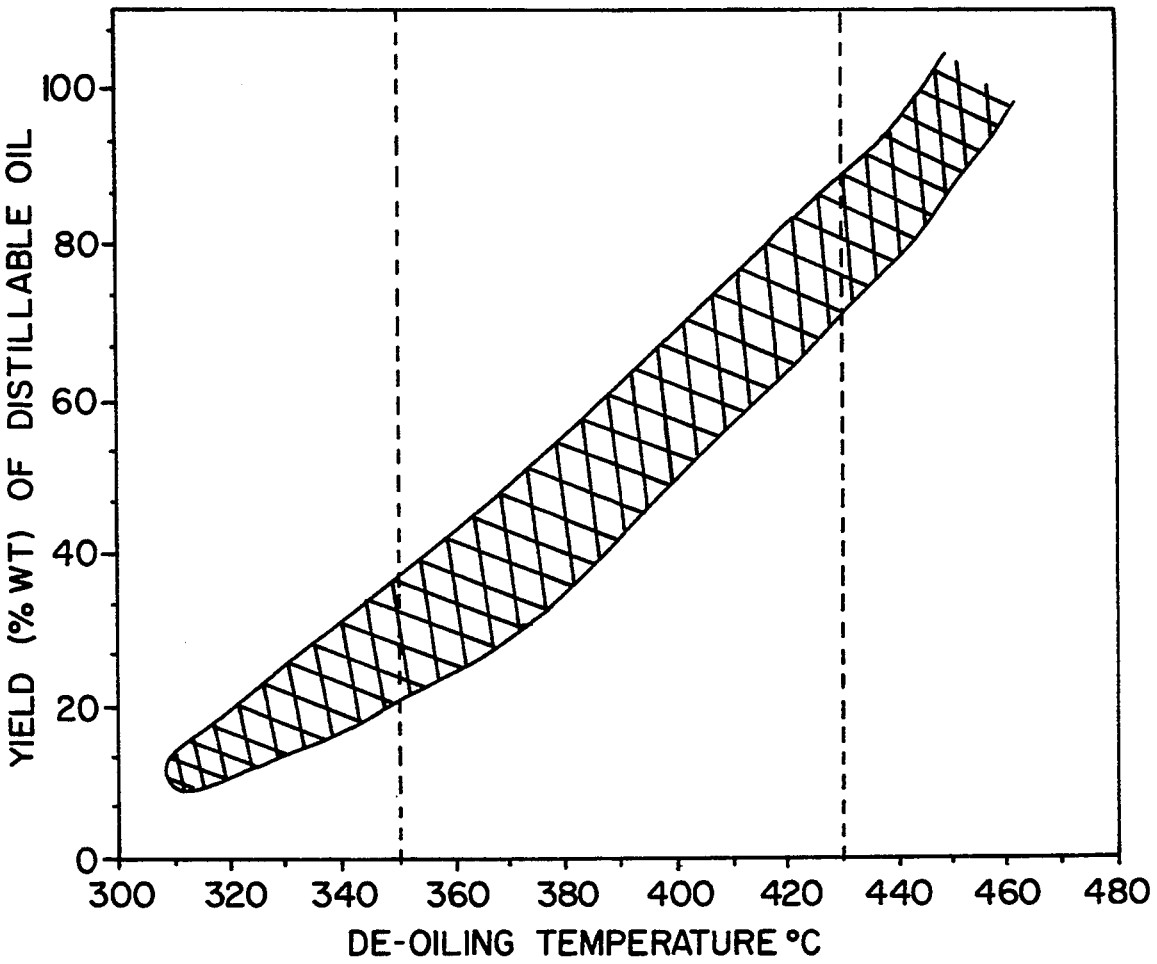
FIG. 1 is a graph illustrating the effect of temperature on the generation of distillable oil from coal/heavy oil agglomerates.

The starting materials used in the process of the present invention are coal fines that have been agglomerated with a bridging liquid. The bridging liquid is either a heavy oil or a mixture of 50–80% heavy oil and 20–50% of a light hydrocarbon diluent, such as kerosene, naphtha or diesel oil. "Heavy oil" means bitumen, heavy crude oil and other oils recognized in the art as heavy oils. The coal fines used can be either bituminous or subbituminous, though bituminous coal fines are normally agglomerated with high quality oils, and subbituminous coal fines with bridging liquids containing heavy oil, so in the preferred embodiment of the invention, agglomerates of subbituminous coal fines are used. The proportion of bridging liquid in the agglomerates is normally from 10–50% by weight of coal.

A preferred process for forming agglomerates of the type used in the present invention, where the coal fines are subbituminous, is described in Canadian Patent No. 1,216,551 (Ignasiak). It is not necessary for the present invention that the coal particles be agglomerated. The process also works with coal/oil blends obtained by other processes, such as mechanical blending. For convenience, the present discussion refers to agglomerates, but it is to be understood that it also applies to blends.

In accordance with the method of the present invention, agglomerates having a particle size in the range of 1.2–2.0 mm, 11.2% bridging oil (based on coal weight) comprising 80% heavy oil and 20% diesel oil, 4.19% moisture and a calorific value of 12,350 BTU/lb (air dry basis) were heated under an atmosphere of steam or nitrogen for residence times from a few minutes up to one hour. This was done by introducing 10 to 20 g of agglomerates into a Vycor tube, purging the tube with inert gas and placing it in an oven preheated to the desired temperature. Steam was introduced to one side of the tube and the other side was hooked up to a water condenser and a cold (CO2) trap placed on top of the condenser. The amount of generated oil collected in a receiver below the condenser and traces of oil in a cold trap were combined and quantitatively determined. Table 1 shows the results obtained when such agglomerates were heated in a steam atmosphere at atmospheric pressure for a residence time of 5 minutes. Typical results of further de-oiling experiments carried out with various agglomerates and coal/oil blends in batch and continuous de-oiling equipment, with residence times ranging from 5–30 minutes in steam or nitrogen atmosphere, are shown in FIG. 1. The recovery of heavy oil varied from 16% at 320° C. to 43% at 410° C. to 71% at 440° C. Under ASTM distillation conditions (Standard No. ASTM D1160) the yields of distillable oil from the same feedstock would be 15% at 320° C., 29% at 410° C. and 37% at 440° C. The de-oiled agglomerates were characterized by high mechanical stability, very low moisture content and a calorific value (on an air dry basis) comparable to that typical of untreated agglomerates and significantly higher than feed coal.

At temperatures above 350° C. the yield of distillable components increases significantly. A temperature of 380° C. is preferred to further increase the yield. At about 400°–420° C., the decomposition of coal and the generation of coal tars commence. The generation of coal tars intensifies above 450° C. Since coal tars are not desirable, the maximum temperature at which the present process is carried out is 450° C. To minimize coal tar formation, a maximum temperature of 420° C. is preferred. At temperatures in the range of 400°–420° C., up to about 90% of the heavy oil can be converted to distillable oils and recovered, in contrast to about 25–40% when the process temperature is 350° C. or below. It has been found that process temperatures in the range of 350°–450° C. do not lower the volatile matter contents of the agglomerates below acceptable levels.

The solid residue that remains after the method of the present invention is carried out contains only the heaviest and most undesirable asphaltenic fraction of the heavy oil. This adds to its calorific value and makes the agglomerates highly hydrophobic and useful as a fuel product. The calorific value of sample agglomerates is shown in Table 1.

TABLE 1

RECOVERY OF OILS FROM COAL AGGLOMERATES

| Temp (°C.) | Oil**** Recovery (wt %) Diesel | Heavy Oil | Total | Moisture* (%) | Ash** (%) | Calorific Value* (BTU/lb) | Elemental Analysis ** C | H | N | S | Volatile Matter (%) *** | Fixed C (%) *** |
|---|---|---|---|---|---|---|---|---|---|---|---|---|
| 320 | 100 | 16 | 33 | 1.9 | 8.3 | 12339 | 73.1 | 4.6 | 1.1 | 0.6 | 38.6 | 61.4 |
| 410 | 100 | 43 | 54 | 2.3 | 8.7 | 12268 | 72.7 | 4.2 | 1.0 | 0.5 | 34.1 | 66.3 |
| 440 | 100 | 71 | 77 | 1.8 | 9.3 | 12288 | 73.4 | 3.8 | 1.2 | 0.4 | 31.0 | 69.0 |

*on air dry agglomerates (relative humidity of 37%)
**dry basis
***dry ash free basis
****based on direct determination of oil Experiments conducted by the inventors show that the high molecular weight (MW) fractions of asphaltene (a component of heavy oil particularly prone to polymerization) deposited on powderized Pyrex (trademark) glass and subjected to heating at 300° C. are significantly more susceptible to polymerization compared to bulk (non-dispersed) fractions. The results are set out in Table 2, showing the weight percent of $CH_2Cl_2$ insolubles formed, which is indicative of polymerization. Spreading the sample over the larger surface of powderized glass supporting material greatly affected the thermolysis process.

TABLE 2

FORMATION OF CH2Cl2 INSOLUBLES (WT %) FROM ASPHALTENE GEL PERMEATION CHROMATOGRAPHY FRACTIONS TREATED IN A GLASS TUBE AT 300° C. IN FORM OF BULK SAMPLES AND AFTER DEPOSITING ON POWDERIZED PYREX GLASS

| Fraction No. | Fraction MW Range | Heating in Glass Tube as: bulk sample | sample deposited on powderized Pyrex glass |
|---|---|---|---|
| 1 | 17000 | 31 | 94 |
| 2 | 13000 | 7.6 | 88 |
| 3 | 8000 | 7.1 | 78 |
| 4 | 4500 | 2.0 | 23 |
| 5 | 1200 | 0 | 11 |

Further experiments have shown that the nature of the material used as a support for the asphaltene is critical in asphaltenic conversion to insolubles by thermal treatment. Table 3 illustrates the results of using powderized quartz, Pyrex, stainless steel and subbituminous coal as supporting materials. when powderized subbituminous coal was used as a support for the asphaltene, no generation of insoluble material was observed, suggesting that subbituminous coal has a positive effect in inhibiting the polymerization reactions of heavy oil deposited on its surface, a property that is of significance in the present invention, where conversion of high molecular weight heavy oil components to lower molecular weight components is essential to the generation and recovery of distillable oil.

TABLE 3

THERMAL TREATMENT OF ASPHALTENE AT 300° C.; EFFECT OF SUPPORTING MATERIAL (ground to 20–40 mesh) ON FORMATION OF CH2Cl2 INSOLUBLES

| Support | Insolubles % |
|---|---|
| none | 0 |
| quartz | 15 |
| Pyrez | 28 |
| stainless steel | 82 |
| subbituminous coal | 0 |

It has been found that considerable conversion of various heavy oil components to lower or higher molecular weight products can take place even at temperatures below 350° C. Experiments were conducted in which an asphaltene separated from Athabaska bitumen was fractionated into 5 molecular weight fractions (using gel permeation chromatography technique) and the fractions as well as the original asphaltene and 1:1 mixture of fractions 1 and 5 were submitted to thermal treatment at 300° C. for a one hour residence time under protective cover of nitrogen gas in a Pyrex glass tube. The results are shown in Table 4. About 3.4% of the original asphaltene is converted to gases during this treatment and this is accompanied by formation of 15.1% pentane soluble products. The asphaltene does not undergo any reactions that would result in generation of insoluble polymerized material. However, 30.6% of the highest molecular weight fraction of the asphaltene (fraction 1) was polymerized during identical thermal treatment. Thermal treatment of lower molecular weight fractions showed an increase in the generation of pentane solubles and a decrease in the formation of insolubles as the molecular weight of the fractions tested decreased.

TABLE 4

PYROLYSIS OF ASPHALTENE AND ITS GEL PERMEATION CHROMATOGRAPHY FRACTIONS AT 300° C. PRODUCT DISTRIBUTION, WT %

| Fraction No. | Fraction MW Range | Gas * | Pentane Soluble | $CH_2Cl_2$ Soluble | $CH_2Cl_2$ Insoluble |
|---|---|---|---|---|---|
| — | Asphaltene | 3.4 | 15.1 | 81.5 | 0 |
| 1 | 17000 | 5.0 | 10.2 | 54.2 | 30.6 |
| 2 | 13000 | 4.0 | 15.2 | 73.2 | 7.6 |
| 3 | 8000 | 6.2 | 17.1 | 69.6 | 7.1 |
| 4 | 4500 | 6.4 | 22.3 | 69.3 | 2.0 |
| 5 | 1200 | 6.7 | 31.6 | 61.7 | 0 |
| 1 + 5 (1:1 | | 5.3 | 17.3 | 75.4 | |

TABLE 4-continued

PYROLYSIS OF ASPHALTENE AND ITS GEL PERMEATION CHROMATOGRAPHY FRACTIONS AT 300° C. PRODUCT DISTRIBUTION, WT %

| Fraction No. | Fraction MW Range | Gas * | Pentane Soluble | $CH_2Cl_2$ Soluble | $CH_2Cl_2$ Insoluble |
|---|---|---|---|---|---|
| ratio) | | | | | |

*by difference

It has also been found that polymerization of asphaltene is affected by the level of mineral matter in the subbituminous coal supporting material. The data in Table 5 shows the increased generation of CH2Cl2 insolubles formed from asphaltene when increased amounts of clay are present in the sample. The process of agglomeration with heavy oil results in the removal of a considerable amount of the mineral matter from the coal, so in the present invention, the reduced level of minerals enhances conversion to lower molecular weight products.

TABLE 5

EFFECT OF CLAY ON POLYMER FORMATION OF HIGH MOLECULAR WEIGHT GEL PERMEATION CHROMATOGRAPHY FRACTION 1 OF ASPHALTENE AT 300° C.

| Clay Content wt % | $CH_2Cl_2$ Insoluble % |
|---|---|
| 1.3 | 30.6 |
| 8.8 | 57.0 |
| 18.3 | 64.0 |

It is believed that there are several factors contributing to the conversion of heavy oil to lighter, distillable oils under the conditions employed in the process of the present invention. The high dispersion of heavy oil on the coal surface facilitates distillation, and steam (where that is the inert gas employed) increases the volatility of the oil. It is believed that the coal surface itself, particularly the surface of low rank coals characterized by the presence of metals in the coal, may catalyze depolymerization. As the more volatile components of the oil are evaporated, the heavier components are left on the coal surface, where their depolymerization would be catalyzed. It has also been found that the coal surface undergoes substantial changes as the temperature increases in the course of thermal treatment. Initially, heteroatoms (particularly carboxylic oxygen) are removed, accompanied by a sudden decrease in porosity and surface area. Above 350° C., development of small pores and rapid surface growth occurs; it is likely that this surface modification has a considerable effect on the conversion of heavy oil. Finally, there is evidence that low rank coals can act as effective hydrogen donors. The surface of the coal may therefore serve the dual function of catalyst and hydrogen donor in the conversion of heavy oil to distillable oil.

Experiments were carried out to assess the effects of the presence of hydrogen donors on the coal surface. Small amounts of dihydroanthracene and tetrahydrocarbazole, in the order of 1% of the oil weight, were blended with the oil prior to deposition of the oil on the coal surface. It was found that the yield of distillable oil was increased when the method of the present invention was carried out, compared to samples without added hydrogen donor. The hydrogen-donating capacity of the system can also be enhanced by carrying out the thermal treatment under partial pressure of a reducing gas, namely hydrogen.

What is claimed is:

1. A method for recovering oil from coal fines agglomerated and/or blended with a bridging liquid comprising heavy oil, comprising the steps of:

(a) heating said agglomerated and/or blended coal fines to temperatures over 350° C. up to 450° C. in an inert atmosphere to catalytically convert and provide a hydrogen source for the conversion of about 43% to about 90% of said heavy oil to lighter, distillable oils; and (b) condensing and collecting said lighter oils whereby the undesirable, heaviest asphaltenic fraction of the heavy oil remains in said agllomerated and/or blended coal fines.

2. A method according to claim 1 wherein said heating step is conducted at temperatures in the range of about 380°–420° C.

3. A method according to claim 1 or 2 wherein said inert atmosphere is steam.

4. A method according to claim 1 or 2 wherein said inert atmosphere is nitrogen.

5. A method according to claim 1 wherein said heating step is conducted at atmospheric pressure.

6. A method according to claim 1 wherein said heating step is conducted at a pressure up to 100 atmospheres.

7. A method according to claim 1 or 2 further comprising the step of collecting a solid residue left after said condensing and collecting step for use as fuel.

8. A method according to claim 1 or 2 wherein said coal fines are subbituminous.

9. A method according to claim 1 or 2 wherein said coal fines are bituminous.

10. A method according to claim 1 or 2 wherein said agglomerated coal fines include a hydrogen donor.

11. A method according to claim 10 wherein said hydrogen donor is dihydroanthracene.

12. A method according to claim 10 wherein said hydrogen donor is tetrahydrocarbazole.

13. A method according to claim 1 wherein said heating step is carried out under partial pressure of hydrogen to increase the hydrogen-donating capacity of the agglomerates.

* * * * *